US011236587B2

(12) United States Patent
Greci et al.

(10) Patent No.: US 11,236,587 B2
(45) Date of Patent: Feb. 1, 2022

(54) MAGNETIC BRAKING SYSTEM AND METHOD FOR DOWNHOLE TURBINE ASSEMBLIES

(71) Applicant: HALLIBURTON ENERGY SERVICES, INC., Houston, TX (US)

(72) Inventors: Stephen Michael Greci, Little Elm, TX (US); Michael Linley Fripp, Carrollton, TX (US); Richard Decena Ornelaz, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 316 days.

(21) Appl. No.: 16/486,965

(22) PCT Filed: Oct. 17, 2018

(86) PCT No.: PCT/US2018/056253
§ 371 (c)(1),
(2) Date: Aug. 19, 2019

(87) PCT Pub. No.: WO2020/081070
PCT Pub. Date: Apr. 23, 2020

(65) Prior Publication Data

US 2021/0332674 A1 Oct. 28, 2021

(51) Int. Cl.
*E21B 41/00* (2006.01)
*E21B 23/00* (2006.01)

(52) U.S. Cl.
CPC ..... *E21B 41/0085* (2013.01); *E21B 23/00* (2013.01)

(58) Field of Classification Search
CPC ..... E21B 41/0085; E21B 23/00
See application file for complete search history.

(56) References Cited

U.S. PATENT DOCUMENTS

| | | | | |
|---|---|---|---|---|
| 4,793,309 | A | 12/1988 | Huffman | |
| 5,821,658 | A | 10/1998 | Boggs, III | |
| 8,678,098 | B2 | 3/2014 | Soni et al. | |
| 2005/0241835 | A1* | 11/2005 | Burris, II | E21B 23/00 166/381 |
| 2015/0061298 | A1 | 3/2015 | Panosyan et al. | |
| 2016/0341013 | A1* | 11/2016 | Hall | E21B 41/0085 |
| 2017/0306725 | A1 | 10/2017 | Hunter | |

(Continued)

FOREIGN PATENT DOCUMENTS

WO 2018093378 A1 5/2018

OTHER PUBLICATIONS

International Search Report and Written Opinion; PCT Application No. PCT/US2018/056253; dated Jul. 15, 2019.

*Primary Examiner* — Brad Harcourt
(74) *Attorney, Agent, or Firm* — Polsinelli PC

(57) ABSTRACT

A turbine assembly is provided for downhole components of a well system. The turbine assembly includes a translational component which translates when a fluid is passed through the turbine assembly. The turbine assembly also includes a braking system which includes one or more magnets in magnetic communication with a conductive component. The braking system enacts a braking force onto the translational component due to the relative translation of the one or more magnets with the conductive component. The braking force from the braking system is proportional to the rate of translation of the translational component.

23 Claims, 6 Drawing Sheets

(56) References Cited

U.S. PATENT DOCUMENTS

| | | | | |
|---|---|---|---|---|
| 2018/0106137 | A1 | 4/2018 | Frosell et al. | |
| 2018/0245428 | A1 | 8/2018 | Richards | |
| 2018/0262126 | A1* | 9/2018 | Gooneratne | E21B 41/0085 |
| 2021/0131204 | A1* | 5/2021 | Marshall | E21B 21/08 |

* cited by examiner

MAGNETIC BRAKING SYSTEM AND METHOD FOR DOWNHOLE TURBINE ASSEMBLIES

CROSS-REFERENCE TO RELATED APPLICATIONS

This application is a national stage entry of PCT/US2018/056253 filed Oct. 17, 2018, said application is expressly incorporated herein in its entirety.

FIELD

The present disclosure relates generally to braking systems for downhole turbine generators. In particular, the present disclosure relates to magnetic braking systems using eddy currents to control the speed of downhole turbine assemblies.

BACKGROUND

Hydrocarbon recovery wells used to extract hydrocarbons from one or more production zones underneath the earth's surface often require downhole power in order to operate components such as actuators, valves, processors, and pressure and temperature sensors in the well.

Electrical power can be provided downhole via an umbilical that is extended from a surface location to the downhole tools. Wireless telemetry methods can also be used for communicating or general interfacing with such components and as a means of facilitating data transmission between the surface operator and the downhole tools. Also, batteries and battery packs can be used for short-term power applications.

Additionally, turbines can be implemented to provide power to downhole tools. Turbines can utilize fluids already flowing through the system during processes such as drilling, production, or fracturing. When events such as injection of fluids at a high rate or a sudden water or gas breakthrough, the turbine may be revved or spun at a rate which may damage the turbine and/or the electronic systems.

BRIEF DESCRIPTION OF THE DRAWINGS

Implementations of the present technology will now be described, by way of example only, with reference to the attached figures, wherein.

DETAILED DESCRIPTION

Figure 1:
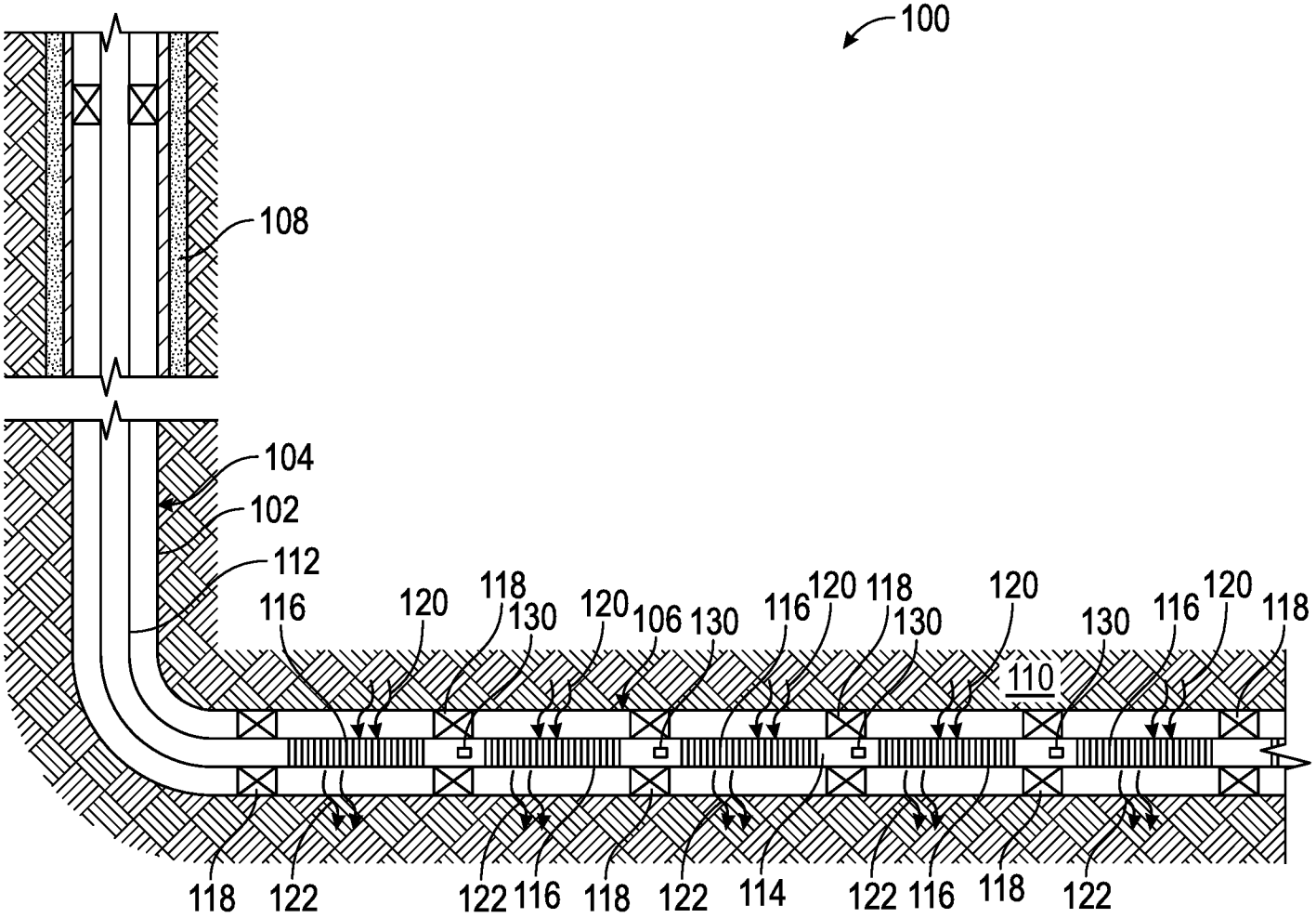
FIG. 1 is a diagram illustrating an exemplary environment for a turbine assembly according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Disclosed herein is a braking system to control the translation of turbine assemblies which generate power for downhole components of a well system. The turbine assembly can include a translational component which translates when a fluid is passed through the turbine assembly, for example through, by, or around a turbine. In at least one example, the translational component can be directly coupled to or a part of the turbine and directly receives the fluid to cause the turbine to translate. In other examples, the translational component can be a separate component which does not directly receive the fluid and translates in coordination with the translation of the turbine. A power generator coupled with the turbine generates power to the downhole components when the translational component translates.

The braking system includes one or more magnets which are in magnetic communication with a conductive component. In at least one example, the conductive component can be the translational component. In other examples, the magnets can be coupled with the translational component and translates. The conductive component can translate and/or remain static. Additionally, the braking components 506, 508 can translate and/or remain static. The translation of the conductive component relative to the magnets induces eddy currents which oppose the translation of the translational component. As such, the braking system enacts a braking force onto the translational component due to the induction of the eddy currents. The braking force is directly proportional to the rate of the translation of the translational component. Therefore, the rate of translation of the translational component is controlled or modulated to smooth the power output from the turbine assembly. If the turbine is over revved downhole for any number of short term events such as injecting at a high rate or a sudden water or gas breakthrough, the braking force is proportionally increased to modulate the translational rate of the translational component. As such, the downhole tools are protected from surges of power and/or from sustained power, and the turbine assembly can be protected from excess vibration.

The braking system can be utilized in any suitable system deployed downhole in a wellbore. For example, the braking system can be utilized on an electronic inflow control device (eICD) turbine generator. The braking system can also be utilized on a density autonomous inflow control device (d-AICD) that utilizes a turbine to rotate to create artificial gravity.

The turbine assembly can be employed in an exemplary well system 100 shown, for example, in FIG. 1. Referring to FIG. 1, illustrated is a well system 100 that includes a wellbore 102 that extends through various earth strata and has a substantially vertical section 104 that extends to a substantially horizontal section 106. The upper portion of the vertical section 104 may have a casing string 108 cemented therein, and the horizontal section 106 may extend through a hydrocarbon bearing subterranean formation 110. In at least one example, the horizontal section 106 may be arranged within or otherwise extend through an open hole section of the wellbore 102. In other examples, however, the horizontal section 106 may also include casing 108 positioned therein, without departing from the scope of the disclosure.

A conveyance 112 may be positioned within the wellbore 102 and extend from the surface (not shown). The conveyance 112 may be any piping, tubular, or fluid conduit including, but not limited to, drill pipe, production tubing, casing, coiled tubing, and any combination thereof. The conveyance 112 provides a conduit for fluids extracted from the formation 110 to travel to the surface. The conveyance 112 may additionally provide a conduit for fluids to be conveyed downhole and injected into the formation 110, such as in an injection operation.

In at least one example, the conveyance 112 may be coupled to a completion string 114 arranged within the horizontal section 106. In other examples, the conveyance 112 and completion string 114 may be considered the same tubing. The completion string 114 can divide the completion interval into various production intervals adjacent the formation 110. The completion interval can be the area within the wellbore 102 where various wellbore operations are to be undertaken using the well system 100, such as production or injection operations. As illustrated in FIG. 1, the completion string 114 includes a plurality of sand control screen assemblies 116 axially offset from each other along portions of the completion string 114. Each screen assembly 116 may be positioned between a pair of packers 118 that provides a fluid seal between the completion string 114 and the wellbore 102, thereby defining corresponding production intervals. In operation, the screen assemblies 116 can filter particulate matter out of production fluid such that particulates and other fines are not produced to the surface and to prevent particulates from clogging portions of the well system 100.

While FIG. 1 illustrates the screen assemblies 116 as being arranged in an open hole portion of the wellbore 102, one or more of the screen assemblies 116 can be arranged within cased portions of the wellbore 102. Also, even though FIG. 1 illustrates a single screen assembly 116 arranged in each production interval, any number of screen assemblies 116 may be deployed within a particular production interval, including omitting screen assemblies 116. Also, while FIG. 1 illustrates multiple production intervals separated by the packers 118, the completion interval may include any number of production intervals with a corresponding number of packers 118 used therein. In other examples, the packers 118 may be entirely omitted from the completion interval, without departing from the scope of the disclosure.

While FIG. 1 illustrates the conveyance 112 and screen assemblies 116 as being arranged in a generally horizontal section 106 of the wellbore 102, the conveyance 112 and screen assemblies 116 can also be implemented in wells having other directional configurations including vertical wellbores, deviated wellbores, slanted wellbores, multilateral wellbores, combinations thereof, and the like.

The well system 100 can be used to undertake various wellbore operations. For example, the well system 100 can be used to extract fluids 120 from the formation 110 and transport those fluids 120 to the surface via the conveyance 112. The fluids 120 can be a fluid composition originating from the surrounding formation 110 and may include one or more fluid components, such as oil, water, gas, oil and water, oil and gas, gas and water, gas and oil, carbon dioxide, or cement. As illustrated, each screen assembly 116 may include one or more well screens (not labeled) arranged about the completion string 114 and may further include one or more flow control devices (not shown) used to regulate or restrict the flow of fluids 120 into the completion string 114, and thereby balance flow among the production zones and prevent water or gas coning.

In other examples, the well system 100 may be used to inject fluids 122 into the surrounding subterranean formation 110, such as in hydraulic fracturing operations, steam-assisted gravity drainage (SAGD) operations, wellbore treatment operations, gravel packing operations, acidizing operations, any combination thereof, and the like. Accordingly, the injected fluids 122 may be water, steam, gas, aqueous or liquid chemicals, slurry, acids, or any combination thereof.

In either production or injection operations, the well system 100 may require the use of various downhole tools 130 including, but not limited to, downhole sensors, telemetry devices, chokes, and valves. The downhole sensors may be positioned along the completion interval and used to measure various wellbore properties, such as pressure, temperature, fluid flow properties, and other properties of the formation and the flowing fluid. The telemetry devices may be communicably coupled to the downhole sensors and otherwise able to communicate the detected wellbore parameters to a surface location. Exemplary telemetry devices include, but are not limited to, acoustic, electromagnetic, and pressure pulse telemetry devices. The chokes and valves may include actuatable flow regulation devices, such as variable chokes and valves, and may be used to regulate the flow of the fluids 120, 122 into and/or out of the completion string 114. To accomplish this, the chokes and valves may require power to be actuated or moved between open and closed positions. In some cases, the telemetry devices may be communicably coupled to the chokes and valves and otherwise configured to receive signals from a surface location and thereby operate the chokes and valves based on these signals.

The downhole sensors, telemetry devices, chokes, and valves described above, and any other suitable downhole tools 130 require electrical power to operate. Given that a typical wellbore operation, such as production operations, may occur over the span of time, for example multiple years, it is often necessary to provide such electrical power to the downhole tools to last the span of time. Electrical power may be generated downhole using a turbine assembly, and the generated electrical power may be consumed by downhole tools 130 associated with the well system 100, such as sensors, telemetry devices, chokes, and valves. As described below, the turbine assembly 200, 30, 40 may be configured to receive a fluid flow circulating through a flow path and convert the kinetic energy provided by the fluid flow into translational energy that can be used to generate electrical power in an adjacent power generator. The flow path and/or the fluid flow may result from production or injection operations undertaken within the well system 100, thereby providing a motive force to power electronics for the time span that the downhole tool is disposed in the wellbore.

Figure 2:
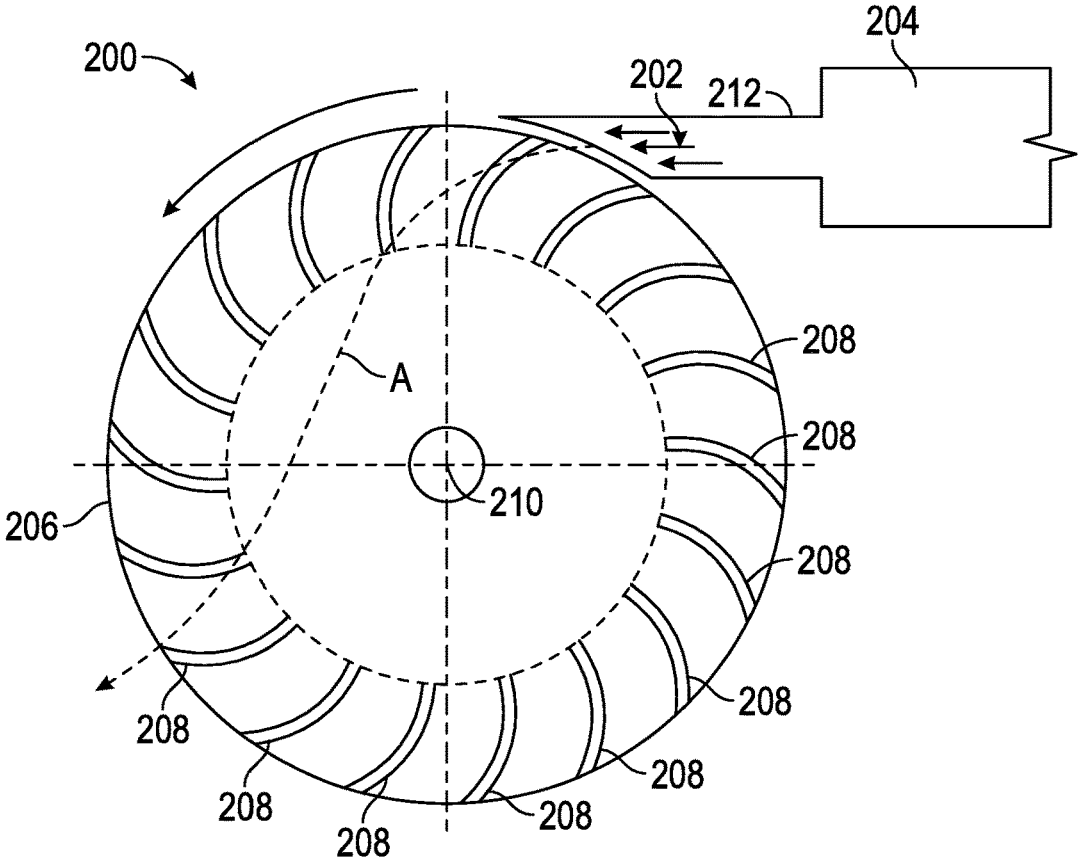
FIG. 2 is a diagram illustrating an exemplary turbine assembly.

FIG. 2 depicts a schematic diagram of an exemplary turbine assembly 200. The turbine assembly 200 may be configured to receive a flow of a fluid 202 from a flow path 204 and convert the kinetic energy and potential energy of the fluid 202 into translational energy that generates electrical power. The fluid 202 may be any of the fluids 120, 122 described above with reference to FIG. 1. Moreover, the flow path includes any route through which the fluid 202 fluid is capable of being transported between at least two points. In some cases, the flow path 204 need not be continuous or otherwise contiguous between the two points. Exemplary flow paths 204 include, but are not limited to, a flow line, a conduit, a pipeline, production tubing, drill string, work string, casing, a wellbore, an annulus defined between a wellbore and any tubular arranged within the wellbore, an annulus defined between a sand screen and a base pipe, any combination thereof, and the like. In FIG. 2, the flow path 204 may be any fluid route that delivers the fluid 202 to the turbine assembly 20 for power generation to downhole tools 130.

The turbine assembly 200 can include a turbine 206 having one or more translational components 208 disposed thereabout and configured to receive the fluid 202. The translational components 208 can be, for example, blades, plates, fins, or any other suitable member which translates when the turbine 206 receives the fluid 202. In at least one example, the translational components 208 can be a part of the turbine 206. In other examples, the translational components 208 can be indirectly coupled with the turbine 206, for example the shaft of the conveyance. In one or more examples, the translational components 208 may include components which do not directly receive the fluid 202 but translates when the fluid 202 passes through the turbine assembly 200, for example through, by, and/or around a turbine 206. As the fluid 202 impinges upon the translational components 208, the turbine 206 is urged to translate, for example rotate about an axis 210. As illustrated in FIG. 2, the fluid 202 in the turbine assembly 200 is perpendicular to the translational axis 210 of the turbine 206.

In some examples, before impinging upon the translational components 208 of the turbine 206, the fluid 202 may pass through a nozzle 212 fluidly coupled to the flow path 204 and otherwise arranged within the flow path 204 upstream from the turbine 206. The nozzle 212 may be used to increase the kinetic energy of the fluid 202, which results in an increased power output from the turbine assembly 200. The turbine 206 may receive the fluid 202 transversely (i.e., across) the translational components 208, and the fluid 202 may flow through the turbine assembly 200, as indicated by the dashed arrow A. As the fluid 202 flows through the turbine assembly 200, the translational components 208 are urged to rotate the turbine 206 about the axis 210 and thereby generate electricity in an associated power generator (not shown). In at least one example, the translational components 208 can translate linearly along a plane. As such, so long as the translational components 208 translate or move, power can be generated by the turbine to the downhole tools 130.

The turbine 206 of FIG. 2 is depicted as a cross-flow turbine but, as discussed below, the turbine 206 may be any other type of turbine that receives a flow of fluid which urges the translational component(s) 208 to translate. For example, the fluid 202 in the turbine assembly 200 could be substantially parallel to the rotational axis 210 of the rotor.

Figure 3:
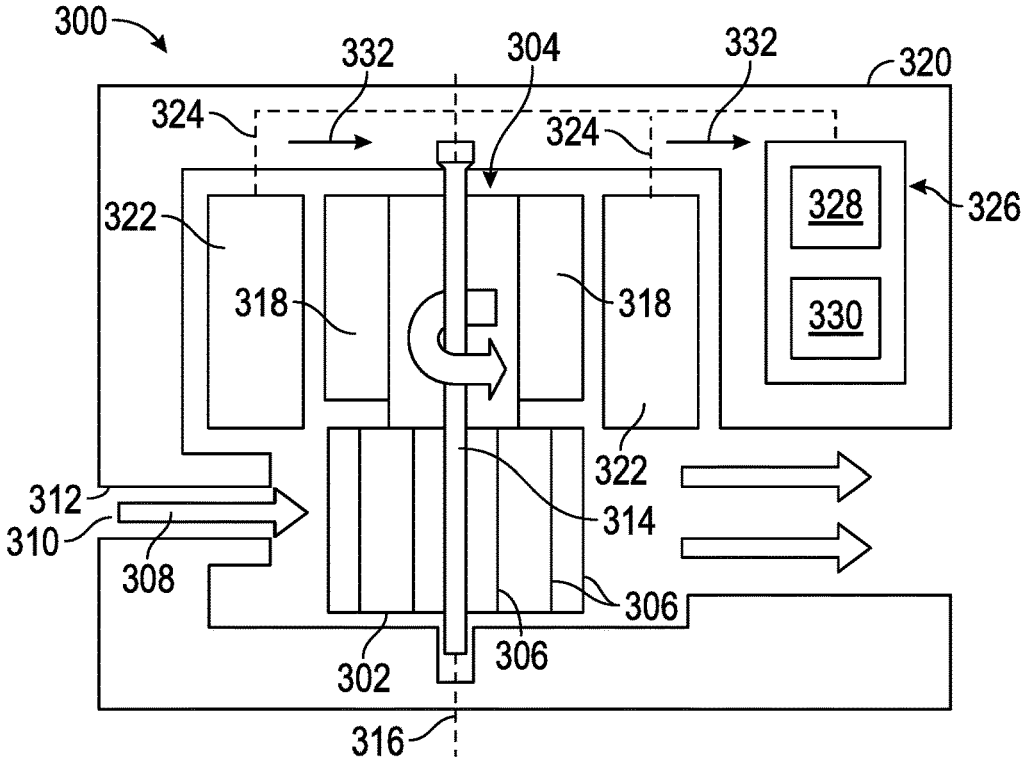
FIG. 3 is a schematic diagram illustrating an exemplary turbine assembly.

FIG. 3 depicts a schematic diagram of another exemplary turbine assembly 300. The turbine assembly 300 is includes a turbine 302 operatively coupled to a power generator 304. The turbine 302 may include one or more translational components 306 disposed thereabout and configured to translate when the turbine 302 receives a flow of a fluid 308 from a flow path 310 and convert the kinetic energy of the fluid 308 into energy that generates electrical power. Similar to the fluid 202 of FIG. 2, the fluid 308 may be any of the fluids 120, 122 described above with reference to FIG. 1. The flow path 310 may include or otherwise be fluidly coupled to a nozzle 312 that increases the kinetic energy of the fluid 308 before impinging upon the translational components 306 of the turbine 302, and thereby increasing the power output from the turbine assembly 300.

The turbine 302 may be operatively coupled to translational components 306 which can include, for example, a rotor 314 that rotates about a rotational axis 316. The rotor 314 may extend into the power generator 304 and may include a plurality of magnets 318 disposed or otherwise positioned thereon for rotation therewith. The power generator 304 may further include a stator 320 and one or more magnetic pickups or coil windings 322 positioned on the stator 320. One or more electrical leads 324 may extend from the coil windings 322 to a power conditioning unit 326, which may include a power storage device 328 and/or a rectifier circuit 330 that operate to store and deliver a steady power supply for use by a load, such as a downhole tool, component, or device. Alternatively, the leads 324 may extend directly to one or more loads to provide electrical power directly thereto.

In the illustrated example, the power generator 304 is positioned in communication with the fluid 308 and otherwise is exposed to the fluid 308. The coil windings 322 and the leads 324 may be encapsulated or sealed with a magnetically-permeable material, such as a polymer, a metal, ceramic, an elastomer, or an epoxy, to protect the coil windings 322 and the leads 324 from potential fluid contamination, which could otherwise lead to corrosion or degradation of those components. As will be appreciated, placing the power generator 304 in the fluid 308 eliminates the need for a dynamic seal around the rotor 314, which could eventually wear out, or the need for magnetic couplers, which may introduce durability issues over extended operation of the power generator 304. In other examples, however, a dynamic seal could be employed, without departing from the scope of the disclosure.

In exemplary operation, the turbine 302 may receive the fluid 308 transversely (i.e., across) the translational components 306, and the fluid 308 may flow through the turbine assembly 300. As the fluid 308 impinges upon the translational components 306, the translational component 306 is urged to translate, for example, rotate about the rotational axis 316, thereby correspondingly rotating the magnets 318 as positioned on the rotor 314. As discussed previously, the translational components 306 can translate in other directions, for example linearly along a plane. The coil windings 322 may be configured to convert the rotational motion of the rotor 314 into electric energy in the form of current 332. More particularly, a magnetic field is generated by the rotational action of the rotor 314, which induces the current 332 in the coil windings 322. In some examples, a magnetic torque coupler (not shown) may be employed between the translational components 306 and magnets 318 of the turbine 302 and the coil windings 322 of the power generator 304. The current 322 traverses the leads 324 extending to the power conditioning unit 326 for storage and rectification. The power conditioning unit 326 may store and deliver a steady power supply for consumption by a load, for example a downhole tool 130 such as a downhole sensor, telemetry device, choke, a digital processing circuit, and/or valve associated with the well system 100 of FIG. 1. Many forms of suitable power storage devices 328 are envisioned including batteries, a capacitive bank, or fuel cells, as examples.

As will be appreciated by those skilled in the art, there are several types of power generators 304 that may be suitable for the examples described herein. In some examples, for example, the power generator 304 may comprise a permanent magnet alternating current (AC) generator that uses pairs of magnets 318 with alternating poles that rotate relative to the coil windings 322 to generate an AC signal. There are multiple generator topologies that can be used depending on the packaging limitations of the application, and different topologies may vary the configuration of the stator 320, the coil windings 322, and the permanent magnets 318 depending on the available space and manufacturing limitations. Exemplary topologies include, but are not limited to, transverse flux, radial flux, and axial flux configurations.

In other examples, the power generator 304 may comprise a direct current (DC) generator, such as a dynamo. In such examples, the generator 304 may use mechanical commutation to generate DC power. The magnetic field can be generated using permanent magnets or field coils, which may be self-excited or externally excited. In yet other examples, the generator 304 may comprise an alternator, which may be similar to the permanent magnet AC generator, but requires an excitation voltage for the coil windings 322 in the place of the permanent magnets 318. Moreover, the generator 304 may be either a brushless generator or a brushed generator, without departing from the scope of the disclosure.

Figure 4:
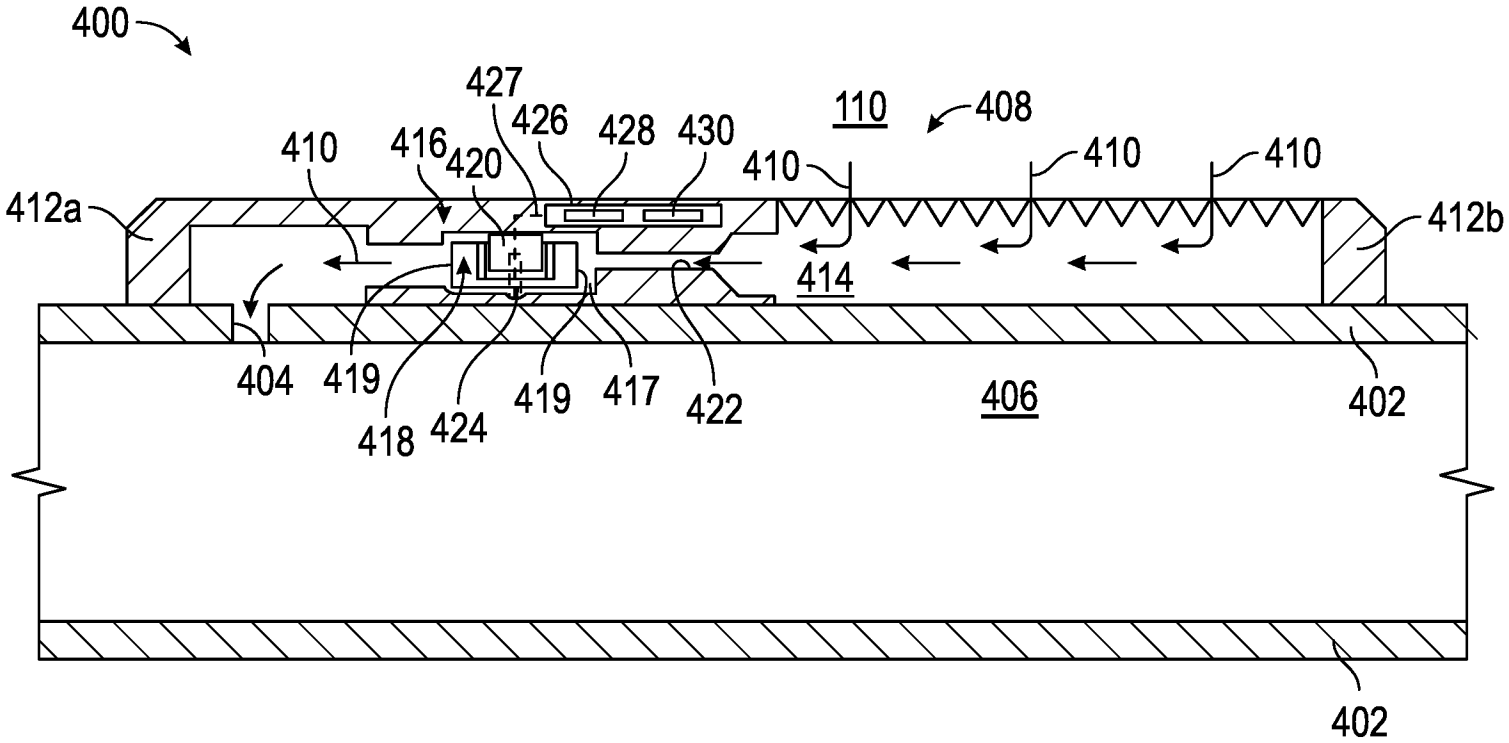
FIG. 4 is a diagram illustrating an example of an exemplary filtration device with a turbine assembly.

FIG. 4 is a cross-sectional view of an exemplary screen assembly 400 which includes an exemplary turbine assembly. Along with the other screen assemblies described in greater detail below, the screen assembly 400 may replace one or more of the screen assemblies 116 described in FIG. 1 and may otherwise be used in the well system 100 depicted therein. The screen assembly 400 (hereafter "the assembly 400") may include or otherwise be arranged about a base pipe 402 that defines one or more openings or flow ports 404 configured to provide fluid communication between an interior 406 of the base pipe 402 and the surrounding subterranean formation 110. While the screen assembly 400 as illustrated in FIG. 4 is positioned external to the base pipe 402, in other examples, the screen assembly 400 can be positioned within the base pipe 402. The base pipe 402 may be similar to or the same as the completion string 114 or the conveyance 112 of FIG. 1.

The assembly 400 may include a sand screen 408 that is attached or otherwise coupled to the exterior of the base pipe 402. In operation, the sand screen 408 and its various components may serve as a filter medium designed to allow fluids 410 derived from the formation 110 to flow therethrough but substantially prevent the influx of particulate matter of a predetermined size. In at least one example, when the screen assembly 400 is positioned within the base pipe 402, the sand screen 408 can also be positioned within the base pipe 402. The same screen 408 can be positioned at any location so long as the sand screen 408 is in position to filter particulate matter. In at least one example, the fluids 410 may be similar to the fluids 120 described above with reference to FIG. 1.

As illustrated in FIG. 4, the sand screen 408 may extend between an upper end ring 412*a* arranged about the base pipe 402 at its uphole end and a lower end ring 412*b* arranged about the base pipe 402 at its downhole end. The upper end ring 412*a* and the lower end ring 412*b* provide a mechanical interface between the base pipe 402 and the opposing ends of the sand screen 408. In one or more examples, however, the lower end ring 412*b* may be omitted from the assembly 400 and the sand screen 408 may be coupled directly to the base pipe 402. Each end ring 412*a*, 412*b* may be formed from a metal, such as 13 chrome, 304 L stainless steel, 316L stainless steel, 420 stainless steel, 410 stainless steel, INCOLOY® 825, iron, brass, copper, bronze, tungsten, titanium, cobalt, nickel, combinations thereof, or the like. Moreover, each end ring 412*a*, 412*b* may be coupled or otherwise attached to the outer surface of base pipe 402 by being welded, brazed, threaded, mechanically fastened, combinations thereof, or the like. In other examples, however, one or both of the end rings 412*a*, 412*b* may be an integral part of the sand screen 408, and not a separate component thereof.

The sand screen 408 may be fluid-porous, particulate restricting device made from of a plurality of layers of a wire mesh that are diffusion bonded or sintered together to form a fluid-porous wire mesh screen. In other examples, however, the sand screen 408 may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. In other examples, however, the sand screen 408 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

As illustrated, the sand screen 408 may be radially offset a short distance from the base pipe 402 so that a flow path 414 for the fluids 410 may be provided within the annulus defined between the sand screen 408 and the base pipe 402. More specifically, the flow path 414 may extend from the subterranean formation 110, through the sand screens 408, through the flow ports 404, and into the interior 406 of the base pipe 402. In other examples, the flow path 414 may include any portion of the aforementioned pathway. For example, the flow path 414 may extend through the flow ports 404 from the subterranean formation 110, and then through the assembly 400 positioned within the base pipe 402.

The assembly 400 includes a turbine assembly 416 positioned within the flow path 414 and otherwise configured to transversely receive a flow of the fluid 410. In some examples, the turbine assembly 416 may be positioned within a cavity 417 defined in the upper end ring 412*a*. Accordingly, the upper end ring 412*a* may be alternatively characterized as a turbine housing that houses the turbine assembly 416. In other examples, the cavity 417 may be defined in a sub operatively coupled to the upper end ring 412*a*. In other examples, the turbine assembly 416 may be positioned within the base pipe 402. The turbine assembly 416 may be positioned at any location such that the turbine assembly 416 is positioned within the flow path 414, and the fluid 410 passes through the turbine assembly 416. The turbine assembly 416 may be similar to any of the turbine assemblies 200, 300 described herein and may, therefore, include a turbine 418 and a power generator 420. Accordingly, the turbine 418 may be any of the turbines described or mentioned herein or any other type of turbine which translates when a fluid is passed through the turbine. The turbine 418 may include a plurality of translational components 419 configured to receive the fluid 410 from the flow path 414. The translational components 419 can be, for example, blades or any other suitable configuration to receive the fluid 410 from the flow path 414 and convert the kinetic energy of the fluid 410 into translational energy, such as rotational energy. The generator 420 generates electrical power when the translational component 419 of the turbine 418 translates. As illustrated, the flow path 414 may include a nozzle 422 in fluid communication with the cavity 417. The nozzle 414 may be configured to increase the kinetic energy of the fluid 410 before the fluid 410 impinges upon the translational components 419 of the turbine 418. In some examples, the nozzle 422 may form part of the upper end ring 412*a*. In other examples, however, the nozzle 422 may be included in a separate sub coupled to the upper end ring 412*a*.

In exemplary operation, the fluid 410 may be drawn into the flow path 414 from the surrounding formation 110, through the sand screen 408, and conveyed into the nozzle 422. The nozzle 422 may eject the fluid 410 into the cavity 417 to be received by the turbine 418, specifically the translational components 419 of the turbine 418. The turbine 418 may receive the fluid 410 transversely (i.e., across) the translational components 419, and the fluid 410 may thereafter flow through the turbine 418. As the fluid 410 impinges upon the translational components 419, the turbine 418 is urged to translate, for example rotate about a rotational axis 424 that is perpendicular to the flow of the fluid 410. Translation of the turbine 418 may allow the generator 420 to generate a current that may be provided to an adjacent power conditioning unit 426 for storage and rectification via one or more electrical leads 427. The power conditioning unit 426 may be similar to or the same as the power conditioning unit 326 of FIG. 3 and, therefore, may include a power storage device 428 and a rectifier circuit 430 used to store and deliver a steady power supply for use by a load (not shown), such as downhole components including a downhole sensor, telemetry device, a digital processing circuit, choke, and/or valve associated with the assembly 400. After passing out of the turbine assembly 416, the fluid 410 may continue within the flow path 414 until entering the interior 406 of the base pipe 402, for example via the flow ports 404.

As will be appreciated, while FIG. 4 depicts the fluid 410 flowing within the flow path 414 from the formation 110 to the interior 406 of the base pipe 402 to generate electricity using the turbine assembly 416, fluids may alternatively flow in the opposite direction in the flow path 414 and equally generate electricity. More particularly, in an injection operation, a fluid (for example, the fluid 122 of FIG. 1) may be conveyed to the assembly 400 within the interior 406 of the base pipe 402 and into the flow path 414 from the flow ports 404. From the flow ports 404, the fluid may traverse the turbine assembly 416 to be injected into the surrounding formation 110. As the fluids pass through the turbine assembly 416, electricity may be generated at the generator 420, as generally described above. In such examples, the position of the nozzle 422 within the flow path 414 may be moved such that it is placed uphole from the turbine assembly 416 and thereby able to increase the kinetic energy of the injection fluids prior to impinging upon the turbine 418.

In FIG. 4, the translational axis 424 of the turbine 418 is extending substantially in the radial direction with respect to the base pipe 402. In other examples, however, the translational axis 424 may alternatively extend in an axial direction with respect to the base pipe 402, without departing from the scope of the disclosure. In such examples, the flow path 414 may be re-routed such that the fluid 410 continues to impinge on the blades of the turbine 418 transversely and otherwise perpendicular to the translational axis 424.

While downhole, turbine assemblies (for example turbine assemblies 200, 300, 416) can be prone to damage if the turbines are over revved, for example by injection at a high rate, production at a high rate, a sudden water or gas breakthrough, or any number of short term events and/or long-term events. As such, if the turbine translates too fast, the turbine assembly may be damaged by vibration, or the downhole tools may be damaged as the turbine assembly provides too much voltage. To avoid such damage, the turbine assembly can include a braking system to reduce and/or control the rate of translation of the turbine.

Figure 5A:
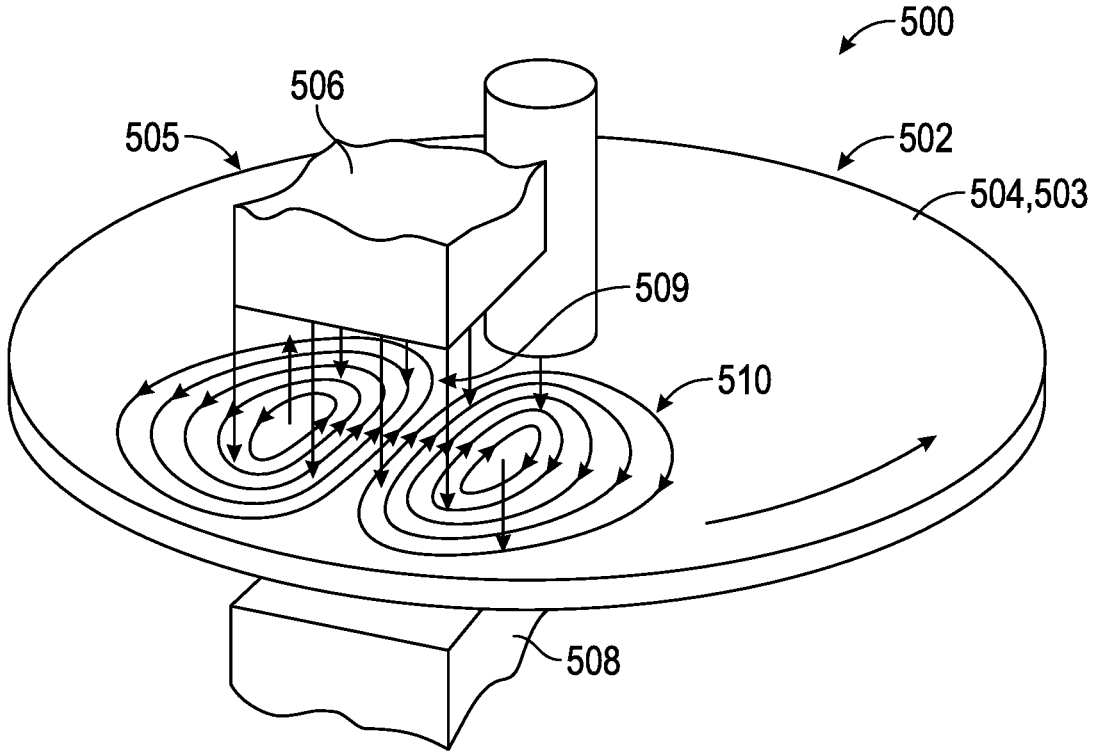
FIG. 5A is a diagram illustrating an example of a braking system for turbine assemblies.
Figure 5B:
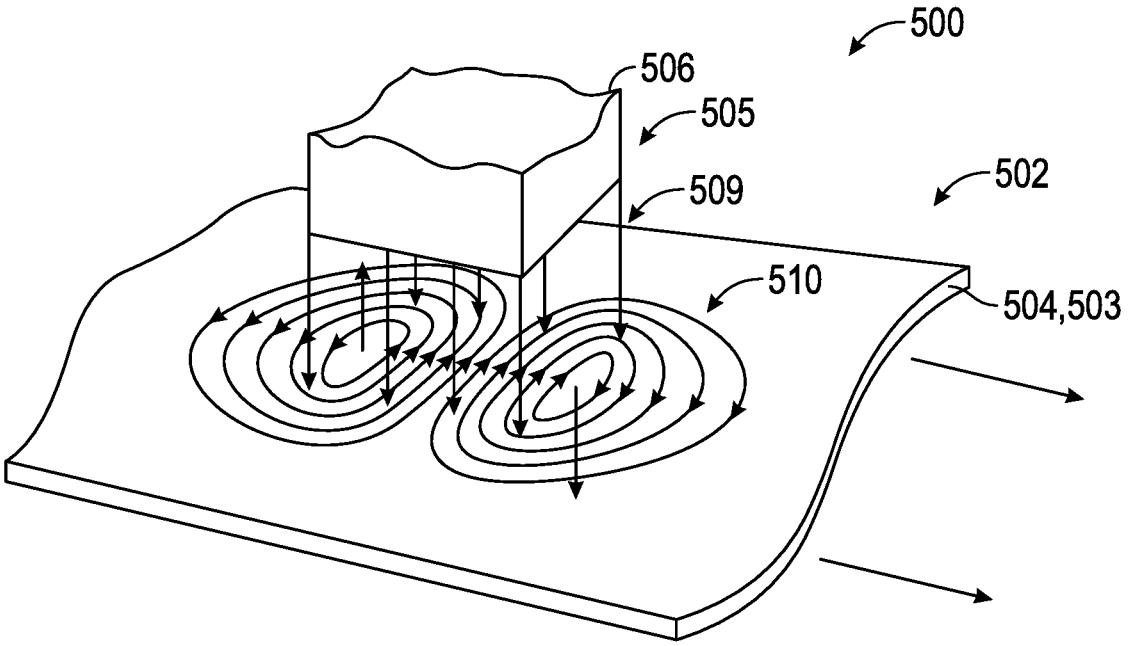
FIG. 5B is a diagram illustrating an example of a braking system for turbine assemblies.

FIGS. 5A and 5B illustrate exemplary turbine assemblies 500 which include a braking system 505 to reduce and/or control the rate of translation of the turbine 504. The turbine assembly 500 as illustrated in FIGS. 5A and 5B include a turbine 502 with a translational component 504 which translates at a rate when a fluid is passed through the turbine 502. FIG. 5A illustrates a turbine 502 with a translational component 504 which rotates about an axis. FIG. 5B illustrates a turbine 502 with a translational component 504 which translates linearly along a plane. The translational component 504 can translate in any suitable way and be connected to any number of components so long as the translational component 504 translates when a fluid is passed through the turbine 502. In at least one example, another component may directly receive the fluid, and directly or indirectly, the translational component 504 translates. In other examples, the translational component 504 may directly receive the fluid.

The translational component 504 can be made of a conductive material, for example iron, copper, steel, aluminum, magnesium, or alloys. The translational component 504 can be ferromagnetic or non-ferromagnetic. Additionally, the translational component 504 can have a non-laminated and/or a solid core. As such, the translational component 504 has greater structural strength and can be manufactured for a reasonable cost.

Figure 6A:
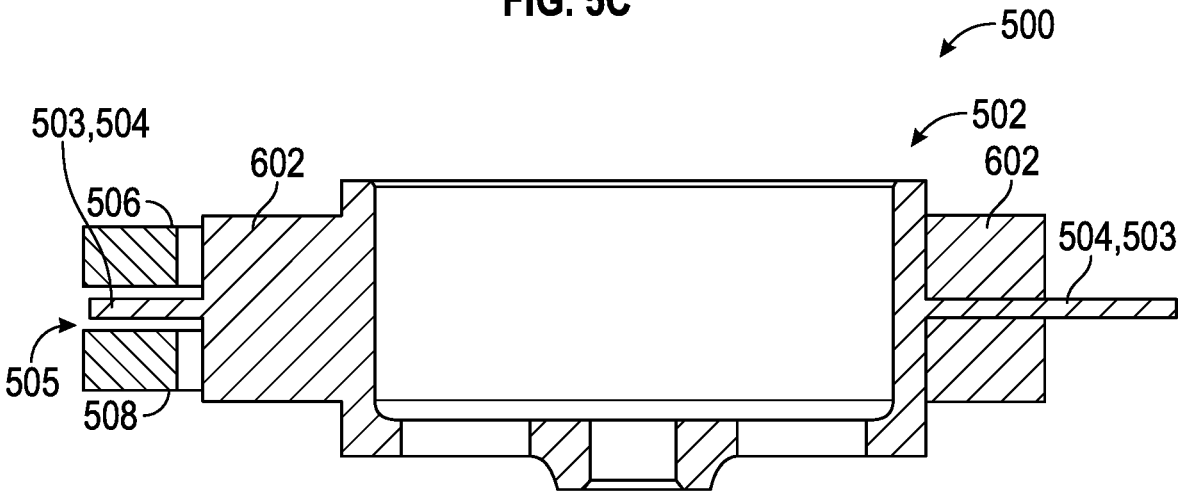
FIG. 6A is a diagram illustrating a cross-sectional view of an example of a braking system for turbine assemblies.
Figure 6B:
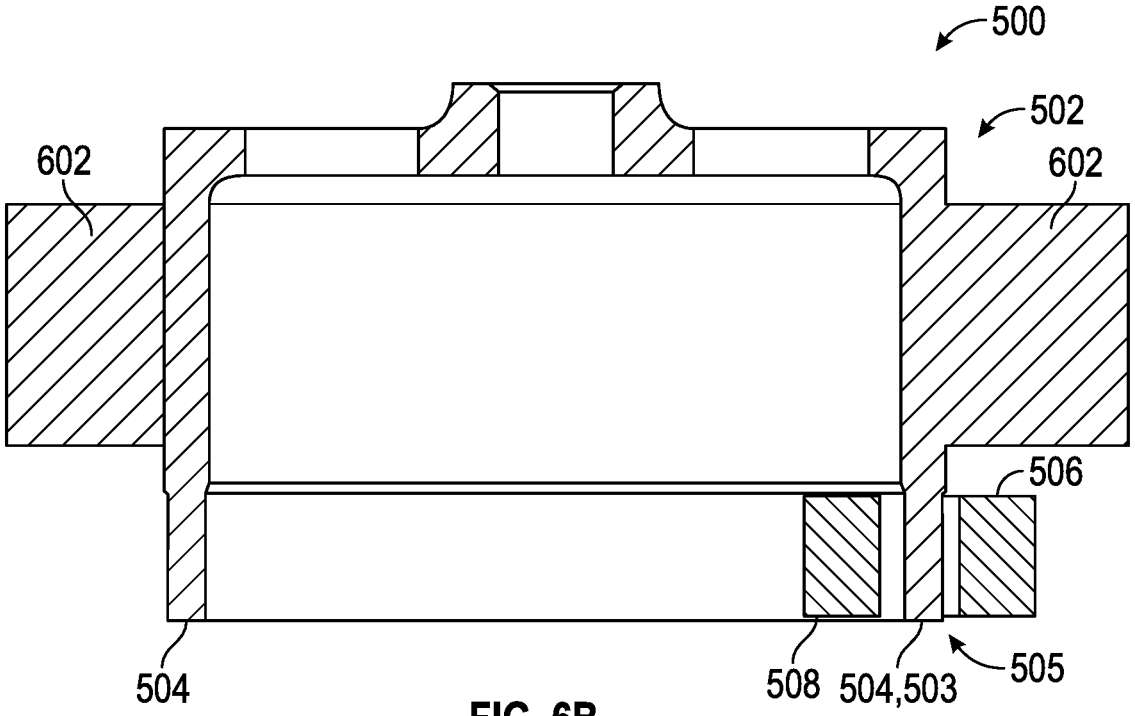
FIG. 6B is a diagram illustrating a cross-sectional view of an example of a braking system for turbine assemblies.

The braking system 505 can include one or more braking components 506, 508 which are in magnetic communication with a conductive component 503. In at least one example, the conductive component 503 can be the translational component 504. As illustrated in FIG. 5A, the braking system 505 includes two braking components 506, 508, where a first braking component 506 is positioned on one side of the translational component 504, and a second braking component 508 is positioned on an opposite side of the translational component 504. In other examples, for example as illustrated in FIG. 5B, the braking system 505 can include only one braking component 506. As illustrated in FIGS. 6A and 6B, the braking components 506, 508 can be positioned along any translational component 504 which translates when fluid is passed through the turbine 502.

As discussed above, the translational component 504 does not necessarily have to be the component which directly receives the fluid. For example, as illustrated in FIG. 6A, the translational component 504 can be a disk which extends radially from the turbine 502. The disk may not directly receive the fluid to cause the translation of the turbine 502. As illustrated in the exemplary turbine 502 of FIG. 6A, fins 602 may directly receive the fluid to cause the translation of the turbine 502, and the disk translates in conjunction with the translation of the turbine 502. As illustrated in FIG. 6A, the braking components 506, 508 can be positioned on either side of the disk. As illustrated in FIG. 6B, the translational component 504 may be, for example, part of a shaft coupled with the turbine 502. Similar to FIG. 6A, as illustrated in the exemplary turbine 502 of FIG. 6B, fins 602 may directly receive the fluid to cause the translation of the turbine 502, and the shaft translates in conjunction with the translation of the turbine 502. As illustrated in FIG. 6B, the braking components 506, 508 can be positioned along the shaft, for example one within the shaft and one external to the shaft. In other examples, only one braking component may be implemented.

Figure 5C:
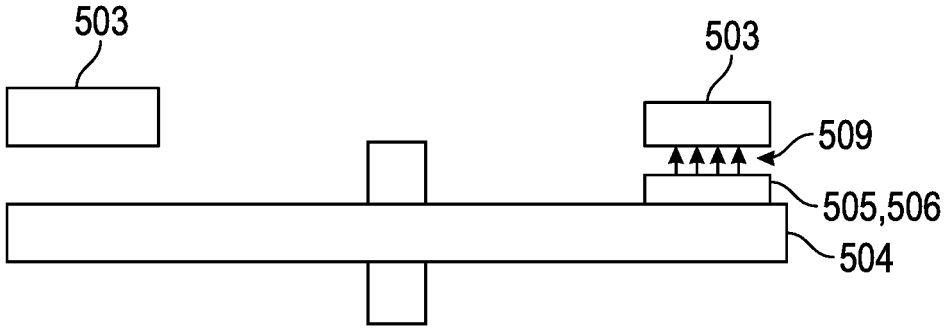
FIG. 5C is a diagram illustrating a cross-sectional view of an example of a braking system for turbine assemblies.

Referring to FIGS. 5A and 5B, the braking components 506, 508 enact a braking force onto the translational component 504 due to the translation of the translational component 504. For example, the braking components 506, 508 can be magnets adjacent to the translational component 504. The magnets can be, for example, permanent magnets or electro-magnets. In at least one example, the translational component 504 is the conductive component 503 and is made of a conductive material such as iron, copper, steel, aluminum, magnesium, or alloys, the translation of the translational component 504 induces eddy currents 510 from the one or more magnetic braking components 506, 508. In other examples, for example as illustrated in FIG. 5C, the braking components 506, 508 can be coupled with the translational component 504, translating along with the translational component 504. The conductive component 503 can translate and/or remain static. Additionally, the braking components 506, 508 can translate and/or remain static. The translation of the conductive component 503 relative to the braking components 506, 508 induces eddy currents which oppose the translation of the translational component 504.

Eddy currents 510 are loops of electrical current induced within the conductive translational component 504 by a changing magnetic field 509. The eddy current 510 flows in planes perpendicular to the magnetic field 509. As such, the eddy current 510 flows along the same plane as the translation of the translational component 504. The eddy current 510 is induced by the relative motion between the magnetic braking components 506, 508 and the conductive component 503, which thereby enacts a braking force onto the translational component 504.

The eddy current 510 opposes the change in the magnetic field 509 that created it. In other words, the eddy current 510 opposes the translation of the translational component 504 and, as such, enacts a braking force onto the translational component 504 due to the translation of the translational component 504. Additionally, the braking force from the braking system 505 is created by the rate of translation of the translational component. For example, when the rate of translation of the translational component 504 increases, the braking system 505 enacts an increasingly greater and/or directly proportional braking force onto the translational component 504. Additionally or alternatively, the distance of the braking components 506, 508 from the conductive component 503 is indirectly proportional to the braking force created by the eddy currents 510. For example, if the braking components 506, 508 are closer to the conductive component 503, the greater the braking force created by the eddy current 510.

By using eddy current 510 to enact a braking force onto the translational component 504 of a turbine 502, the rate of translation of the translational component 504 is controlled and/or reduced. As discussed above, if the turbine translates too fast, the turbine assembly may be damaged by vibration, or the downhole tools may be damaged as the turbine assembly provides too much voltage. Since the braking force is proportional to the rate of translation of the translational component 504, the rate of the translational component 504 is modulated which can also smooth the power output by the turbine assembly 500. As such, the electrical power can be more efficiently and consistently produced.

When the conductive component 503 has a non-laminated and/or a solid core, the braking force by the eddy current 510 does not damage the conductive component 503. If the conductive component 503 has a laminated core, the braking force by the eddy current 510 may de-laminate layers of the conductive component 503. Additionally, as the braking components 510 are not in direct physical contact with the conductive component 503, the braking system 505 does not create friction and heat which can damage the turbine 502. The braking system 505 also does not become jammed by particles or wear out.

Figure 7:
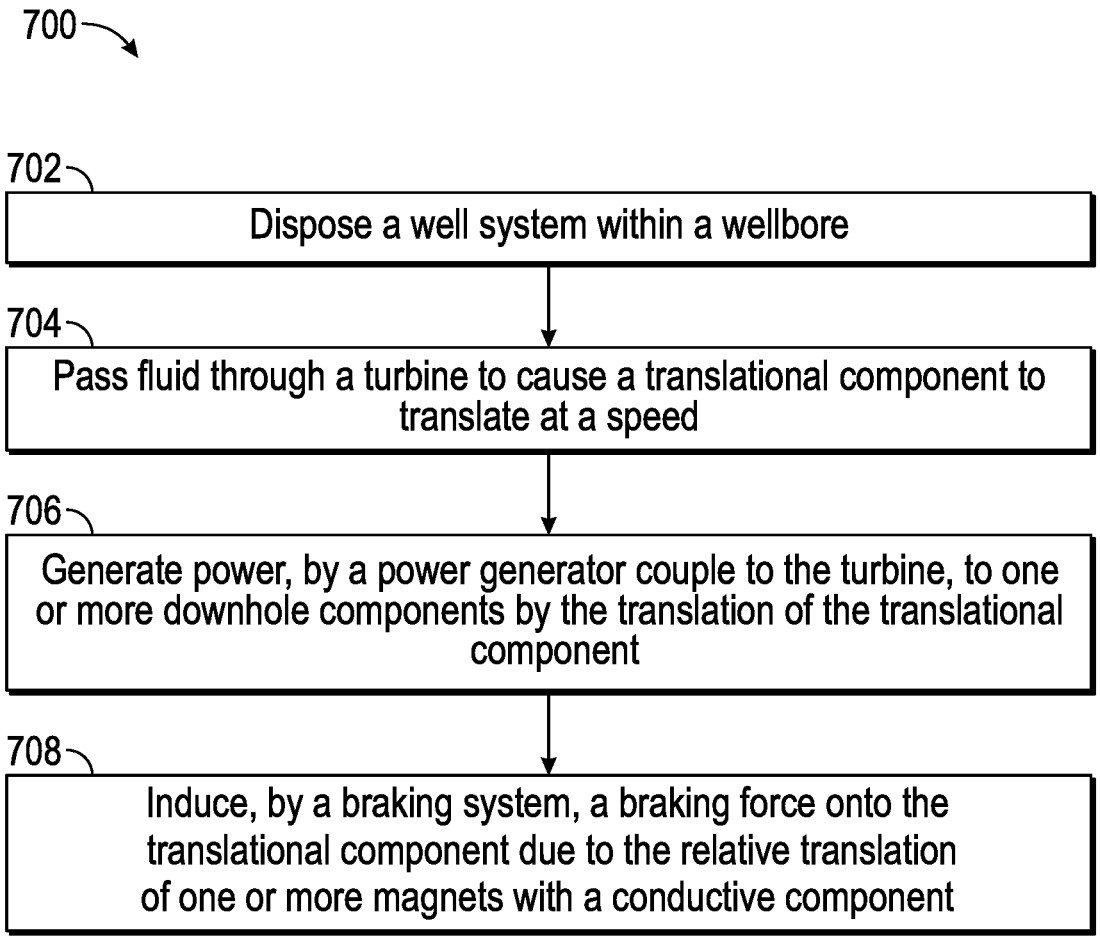
FIG. 7 is a flow chart of a method for utilizing an exemplary filtration device.

Referring to FIG. 7, a flowchart is presented in accordance with an example embodiment. The method 700 is provided by way of example, as there are a variety of ways to carry out the method. The method 700 described below can be carried out using the configurations illustrated in FIGS. 1-6B, for example, and various elements of these figures are referenced in explaining example method 700. Each block shown in FIG. 7 represents one or more processes, methods or subroutines, carried out in the example method 700. Furthermore, the illustrated order of blocks is illustrative only and the order of the blocks can change according to the present disclosure. Additional blocks may be added or fewer blocks may be utilized, without departing from this disclosure. The example method 700 can begin at block 702.

At block 702, a well system is disposed within a wellbore. The well system includes one or more downhole components and a turbine assembly including a turbine. The turbine is configured to translate, for example rotate, when a fluid is passed through the turbine.

At block 704, fluid is passed through the turbine assembly to cause the translational component to translate at a rate. The translational component can be any component which translates when the turbine translates. The translational component can be a component which directly receives the fluid and converts the flow of the fluid to translational energy. In other examples, the translational component can be a component coupled with the turbine and translates when the turbine translates. The translational component can be made of a conductive material such as iron, copper, steel, aluminum, magnesium, or alloys. The translational component can also have a non-laminated and/or solid core.

At block 706, power is generated by a power generated coupled to the turbine. The power is provided to the one or more downhole components by the translation of the translational component. As the turbine, and correspondingly the translational component, translates, power is generated and transmitted to the downhole components. The faster the turbine translates, the greater the voltage that is transmitted to the downhole components. As such, if the turbine is over revved for any number of events such as injecting at a high rate or a sudden water or gas breakthrough, the turbine may suffer damage for example from vibration, and the downhole tools may suffer damage by receiving too great a voltage.

At block 708, a braking force is induced by a braking system in magnetic communication with a conductive component. A braking force is enacted onto the translational component due to the translation of the translational component. The braking system can include one or more magnets adjacent to the conductive component. In at least one example, the translational component is the conductive component and is made of a conductive material, and the translation of the translational component induces eddy currents from the one or more magnets. In other examples, the magnets are coupled with the translational component, translating with the translational component, and the conductive component is separate component. The relative movement between the magnets and the conductive component induces the eddy currents, which thereby enact a braking force onto the translational component. The braking force is directly proportional with the rate of translation of the translational component. As such, the rate of translation of the translational component (and subsequently the turbine) is modulated and controlled. Additionally, as the braking system is not in direct physical contact with the conductive component, friction is not created as the braking system induces the braking force. Also, the braking system is not affected by particles which may clog other physical braking systems.

Numerous examples are provided herein to enhance understanding of the present disclosure. A specific set of statements are provided as follows.

Statement 1: A turbine assembly is disclosed for downhole components of a well system, the turbine assembly comprising: a translational component which translates when a fluid is passed through the turbine assembly; and a braking system including one or more magnets in magnetic communication with a conductive component, the braking system enacting a braking force onto the translational component due to the relative translation of the one or more magnets with the conductive component, wherein the braking force from the braking system is proportional to the rate of translation of the translational component.

Statement 2: A turbine assembly is disclosed according to Statement 1, wherein when a rate of translation of the translational component increases, the braking system enacts an increasingly greater braking force onto the translational component.

Statement 3: A turbine assembly is disclosed according to Statements 1 or 2, wherein the braking force from the braking system is created by the translation of the translational component.

Statement 4: A turbine assembly is disclosed according to any of preceding Statements 1-3, wherein the one or more magnets translate along with the translational component.

Statement 5: A turbine assembly is disclosed according to any of preceding Statements 1-4, wherein the relative translation of the conductive component with the one or more magnets induces eddy currents.

Statement 6: A turbine assembly is disclosed according to any of preceding Statements 1-5, wherein the translational component is the conductive component and is made of a conductive material.

Statement 7: A turbine assembly is disclosed according to any of preceding Statements 1-6, wherein the conductive component has a non-laminated and/or a solid core.

Statement 8: A turbine assembly is disclosed according to any of preceding Statements 1-7, wherein the translation of the translational component is rotated about an axis.

Statement 9: A turbine assembly is disclosed according to any of preceding Statements 1-8, wherein the translational component translates linearly along a plane.

Statement 10: A turbine assembly is disclosed according to any of preceding Statements 1-9, wherein the braking force opposes the translation of the translational component.

Statement 11: A system is disclosed comprising: a well system disposed within a wellbore through which fluids are passed, the well system including: one or more downhole components; a turbine assembly for the one or more downhole components, the turbine assembly including: a translational component which translates when a fluid is passed through the turbine assembly; and a braking system including one or more magnets in magnetic communication with a conductive component, the braking system enacting a braking force onto the translational component due to the relative translation of the one or more magnets with the conductive components, wherein the braking force from the braking system is proportional to the rate of translation of the translational component.

Statement 12: A system is disclosed according to Statement 11, wherein the braking force from the braking system is created by the translation of the translational component.

Statement 13: A system is disclosed according to Statements 11 or 12, wherein the one or more magnets translate along with the translational component.

Statement 14: A system is disclosed according to any of preceding Statements 11-13, wherein the relative translation of the conductive component with the one or more magnets induces eddy currents.

Statement 15: A system is disclosed according to any of preceding Statements 11-14, wherein the translational component is the conductive component and is made of a conductive material.

Statement 16: A system is disclosed according to any of preceding Statements 11-15, wherein the conductive component has a non-laminated and/or a solid core.

Statement 17: A system is disclosed according to any of preceding Statements 11-16, wherein the braking force opposes the translation of the translational component.

Statement 18: A method is disclosed comprising: disposing a well system within a wellbore, the well system including one or more downhole components and a turbine assembly; passing fluid through the turbine assembly to cause a translational component to translate at a rate; and inducing, by a braking system, a braking force onto the translational component due to the relative translation of one or more magnets with a conductive component, wherein the braking force is proportional to the rate of translation of the translational component.

Statement 19: A method is disclosed according to Statement 18, wherein the one or more magnets translate along with the translational component.

Statement 20: A method is disclosed according to Statements 19 or 20, wherein the relative translation of the conductive component with the one or more magnets induces eddy currents.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A turbine assembly for downhole components of a well system, the turbine assembly comprising:

a translational component which translates when a fluid is passed through the turbine assembly; and a braking system including one or more magnets in magnetic communication with a conductive component, the braking system enacting a braking force onto the translational component due to the relative translation of the one or more magnets with the conductive component, wherein the braking force from the braking system is proportional to the rate of translation of the translational component due to the braking force being directly created by the relative translation of the one or more magnets with the conductive component caused by the translation of the translational component.

2. The turbine assembly of claim 1, wherein when a rate of translation of the translational component increases, the braking system enacts an increasingly greater braking force onto the translational component.

3. The turbine assembly of claim 1, wherein the braking force from the braking system is created by the translation of the translational component.

4. The turbine assembly of claim 1, wherein the one or more magnets translate along with the translational component.

5. The turbine assembly of claim 1, wherein the relative translation of the conductive component with the one or more magnets induces eddy currents.

6. The turbine assembly of claim 1, wherein the translational component is the conductive component and is made of a conductive material.

7. The turbine assembly of claim 1, wherein the conductive component has a non-laminated and/or a solid core.

8. The turbine assembly of claim 1, wherein the translation of the translational component is rotated about an axis.

9. The turbine assembly of claim 1, wherein the translational component translates linearly along a plane.

10. The turbine assembly of claim 1, wherein the braking force opposes the translation of the translational component.

11. A system comprising:

a well system disposed within a wellbore through which fluids are passed, the well system including:

one or more downhole components;

a turbine assembly for the one or more downhole components, the turbine assembly including:

a translational component which translates when a fluid is passed through the turbine assembly; and a braking system including one or more magnets in magnetic communication with a conductive component, the braking system enacting a braking force onto the translational component due to the relative translation of the one or more magnets with the conductive component, wherein the braking force from the braking system is proportional to the rate of translation of the translational component due to the braking force being directly created by the relative translation of the one or more magnets with the conductive component caused by the translation of the translational component.

12. The system of claim 11, wherein the braking force from the braking system is created by the translation of the translational component.

13. The system of claim 11, wherein the one or more magnets translate along with the translational component.

14. The system of claim 11, wherein the relative translation of the conductive component with the one or more magnets induces eddy currents.

15. The system of claim 11, wherein the translational component is the conductive component and is made of a conductive material.

16. The system of claim 11, wherein the conductive component has a non-laminated and/or a solid core.

17. The system of claim 11, wherein the braking force opposes the translation of the translational component.

18. A method comprising:

disposing a well system within a wellbore, the well system including one or more downhole components and a turbine assembly;

passing fluid through the turbine assembly to cause a translational component to translate at a rate; and inducing, by a braking system, a braking force onto the translational component due to the relative translation of one or more magnets with a conductive component, wherein the braking force is proportional to the rate of translation of the translational component due to the braking force being directly created by the relative translation of the one or more magnets with the conductive component caused by the translation of the translational component.

19. The method of claim 18, wherein the one or more magnets translate along with the translational component.

20. The method of claim 18, wherein the relative translation of the conductive component with the one or more magnets induces eddy currents.

21. A turbine assembly for downhole components of a well system, the turbine assembly comprising:

a translational component which translates when a fluid is passed through the turbine assembly; and a braking system including one or more magnets in magnetic communication with a conductive component, the braking system enacting a braking force onto the translational component due to the relative translation of the one or more magnets with the conductive component, wherein the braking force from the braking system is proportional to the rate of translation of the translational component, wherein the one or more magnets translate along with the translational component.

22. A system comprising:

a well system disposed within a wellbore through which fluids are passed, the well system including:

one or more downhole components;

a turbine assembly for the one or more downhole components, the turbine assembly including:

a translational component which translates when a fluid is passed through the turbine assembly; and a braking system including one or more magnets in magnetic communication with a conductive component, the braking system enacting a braking force onto the translational component due to the relative translation of the one or more magnets with the conductive component, wherein the braking force from the braking system is proportional to the rate of translation of the translational component, wherein the one or more magnets translate along with the translational component.

23. A method comprising:

disposing a well system within a wellbore, the well system including one or more downhole components and a turbine assembly;

passing fluid through the turbine assembly to cause a translational component to translate at a rate; and inducing, by a braking system, a braking force onto the translational component due to the relative translation of one or more magnets with a conductive component, wherein the braking force is proportional to the rate of translation of the translational component, wherein the one or more magnets translate along with the translational component.

* * * * *